US011882944B1

(12) United States Patent
Hilliard

(10) Patent No.: US 11,882,944 B1
(45) Date of Patent: Jan. 30, 2024

(54) DIAPER CHANGING DEVICE

(71) Applicant: Rion Hilliard, Edgewater, FL (US)

(72) Inventor: Rion Hilliard, Edgewater, FL (US)

( * ) Notice: Subject to any disclaimer, the term of this patent is extended or adjusted under 35 U.S.C. 154(b) by 0 days.

(21) Appl. No.: 17/670,645

(22) Filed: Feb. 14, 2022

Related U.S. Application Data

(60) Provisional application No. 63/149,098, filed on Feb. 12, 2021.

(51) Int. Cl.
*A47D 5/00* (2006.01)

(52) U.S. Cl.
CPC ..... *A47D 5/00* (2013.01)

(58) Field of Classification Search
CPC ..... A47D 5/00
See application file for complete search history.

(56) References Cited

U.S. PATENT DOCUMENTS

| | | | | |
|---|---|---|---|---|
| 3,721,434 | A | 3/1973 | Spies | |
| 4,522,381 | A | 6/1985 | Ludwick | |
| 4,712,258 | A | 12/1987 | Eves | |
| 5,161,270 | A | 11/1992 | Najmabadi | |
| 5,718,011 | A | 2/1998 | Nogues | |
| 5,987,677 | A | 11/1999 | Betker | |
| 6,009,874 | A | 1/2000 | Sartin et al. | |
| 6,224,152 | B1 | 5/2001 | Hughes et al. | |
| 6,272,704 | B1 | 8/2001 | Cutler | |
| 6,389,624 | B1 | 5/2002 | Madole | |
| 6,981,289 | B2 * | 1/2006 | Mueller | A47D 5/006 5/655 |
| 7,725,170 | B2 | 6/2010 | Emerson | |
| 8,117,698 | B1 | 2/2012 | Khaze Harry | |
| 9,032,572 | B1 * | 5/2015 | Leach | A47D 5/00 5/655 |
| D743,186 | S | 11/2015 | Perdue et al. | |
| D800,480 | S | 10/2017 | Paperno | |
| D809,825 | S | 2/2018 | Clores | |
| 10,016,066 | B2 | 7/2018 | Howard | |
| 10,178,916 | B2 | 1/2019 | Villei | |
| 2011/0209716 | A1 | 9/2011 | Scarsbrook | |
| 2015/0045608 | A1 | 2/2015 | Karp et al. | |
| 2015/0296998 | A1 * | 10/2015 | Wyler | A47D 5/006 5/655 |
| 2016/0213165 | A1 | 7/2016 | Behrman | |
| 2021/0315391 | A1 * | 10/2021 | Vroom | A47D 15/00 |

* cited by examiner

*Primary Examiner* — Justin C Mikowski
*Assistant Examiner* — Adam C Ortiz
(74) *Attorney, Agent, or Firm* — John Rizvi; John Rizvi, P.A.—The Patent Professor

(57) ABSTRACT

A diaper changing device which can assist parents or other caregivers in changing an infant or other subject's diaper may include a base. The base may be flat. At least one diaper retainer tab may be provided on the base. The at least one diaper retainer tab may be configured to engage and secure a diaper in place on the base. The base and the at least one diaper retainer tab may be used by a caregiver to maintain the diaper in an easily reachable, strategically placed position as the diaper on an infant or adult is changed, allowing a caregiver to operate a front end of the diaper and wrap the front end over the subject. The caregiver may easily and rapidly pull the base frontward from the diaper to disconnect the diaper changing device from the diaper and finalize the diapering process.

17 Claims, 8 Drawing Sheets

DIAPER CHANGING DEVICE

CROSS-REFERENCE TO RELATED APPLICATION

This application claims the benefit of U.S. Provisional Patent Application No. 63/149,098, filed on Feb. 12, 2021, which is incorporated herein by reference in its entirety.

FIELD OF THE INVENTION

The present invention relates generally to diapers, and more particularly, to a diaper changing device which can assist parents or other caregivers in changing diapers.

BACKGROUND OF THE INVENTION

A diaper is a type of undergarment which allows a wearer to urinate or defecate therewithin by absorbing and containing bodily fluids and solids. Diapers may be worn by both infants and adults. In the former case, infants have not learned to exercise volitional control over the urination and defecation urges which are learned through practice, commonly known as "toilet training". In turn, some adults have lost such control because of a stroke, dementia, or other health condition.

Parents and other caregivers need to regularly replace the soiled diapers of infants who are not yet toilet trained. Both at home and away from home, however, it may be difficult for caregivers to find a suitable surface on which to place an infant while changing the diaper of the infant. Changing of a diaper may require a generally flat surface on which the infant is rested to remove the diaper, clean the infant, and deploy a replacement diaper on the infant. Many public restrooms, however, are not designed to facilitate easy changing of the infant's diaper. In consequence, changing of the diaper may need to be performed on a countertop within the restroom. However, countertops may have drawbacks which do not easily lend themselves to changing the diapers of infants. For example, countertops typically have a flat surface with at least one edge above and facing the floor. Accordingly, there is a danger that the infant being changed may roll or fall off the countertop edge onto the floor. Moreover, there is a potential for contamination of the countertop, potentially exposing subsequent users of the countertop to unsanitary conditions.

Child carriers which are commonly used to transport infants may not provide suitable surfaces for changing the diaper of the infant. Conventional cribs or bassinets may require substantial space and are difficult to transport. Other types of devices may not isolate and prevent surfaces from becoming soiled with waste, thereby increasing a risk of contaminating a diaper and infant in the event that a diaper change is carried out on said other types of devices.

Some public restrooms are equipped with wall-mounted infant changing stations. A wall-mounted infant changing station may include a wall-mounted frame. A bed may be pivotally attached to the frame. When the changing station is not in use, the bed may be pivoted against the frame to conserve space in the restroom. When use of the changing station is desired, the bed may be pivoted away from the frame to provide a flat surface on which the diaper of the infant may be changed. In many cases, however, wall-mounted infant changing stations may not be feasible or available.

One of the more difficult challenges in changing a diaper is being able to retrieve the diaper fasteners from beneath the child or adult in order to quickly and successfully fasten the diaper. If the person being diapered is moving in any way (squirming or trying to roll over, for example) it becomes quite a challenge to position the diaper and retrieve the diaper fasteners. This and other challenges are increasingly difficult to overcome if the surface on which the diaper is being changed is small or irregular, or potentially unclean.

Accordingly, there is need for a diaper changing device which can assist parents or other caregivers in changing disposable or reusable diapers.

SUMMARY OF THE INVENTION

The present invention is directed to a diaper changing device which can assist parents or other caregivers in changing diapers, such as, but not limited to, disposable or reusable diapers. The diaper changing device may include a base. At least one diaper retainer tab may be provided on the base. The at least one diaper retainer tab may be configured to engage and secure a diaper in place on the base. The base and the at least one diaper retainer tab may be used by a caregiver to maintain diaper fasteners on the diaper in an easily reachable, strategically placed position as the diaper on an infant or adult is changed.

In a first implementation of the invention, a diaper changing device suitable for assisting a caregiver in changing a diaper on a subject may include a base, configured to support a diaper in an extended and flattened position, and at least one diaper retainer tab carried by the base and configured to engage the diaper. The diaper changing device may be configured to adopt a usage configuration in which a diaper is extended and flattened on the base, and further in which the at least one diaper retainer tab engages the diaper and prevents a relative movement between the diaper and the base while maintaining a front end portion of the diaper free to be separated from the base and wrapped over a subject resting on the diaper.

In a second aspect, the base may be generally flat.

In another aspect, the base may be generally non-stretchable.

In another aspect, the base may be elongated along a front-to-back, longitudinal direction. In the usage configuration, the base may extend frontward of the diaper.

In another aspect, in the usage configuration, the base may extend transversely beyond a left side and a right side of the diaper.

In yet another aspect, in the usage configuration, the at least one diaper retainer tab may prevent a frontward movement of the diaper relative to the base when the front end of the diaper is pulled frontward relative to the base in the usage configuration.

In another aspect, the at least one diaper retainer tab may include a pair of diaper retainer tabs arranged on a left side and a right side of the base in spaced-apart relationship with one another and configured to engage a left side and a right side of the diaper.

In another aspect, the base may include a central portion and a pair of wing portions. The central portion may be elongately formed along a front-to-back, longitudinal direction. Each wing portion of the pair of wing portions may extend transversely outward from a respective left and right side of the central portion. Each diaper retainer tab of the pair of diaper retainer tabs may be arranged on a respective wing portion of the pair of wing portions.

In another aspect, the at least one diaper retainer tab may protrude from a top surface of the base.

In yet another aspect, a free end of the at least one diaper retainer tab may be sloped towards the top surface of the base.

In another aspect, each diaper retainer tab of the at least one diaper retainer tab may be arranged adjacent to a rear end of the base.

In another aspect, each diaper retainer tab of the at least one diaper retainer tab may be oriented rearward.

In another aspect, the at least one diaper retainer tab may be configured to disconnectably engage the diaper.

In yet another aspect, in the usage configuration, the base may be disconnected from the diaper by pulling the base frontward relative to the diaper to disengage the diaper from the at least one diaper retainer tab.

In another aspect, the base may further include at least one hand grip member configured to facilitate a frontward pulling of the base relative to the diaper in the usage configuration.

In another aspect, the at least one hand grip member may be arranged frontward of the diaper in the usage configuration.

In another aspect, the at least one hand grip member may be provided at or in proximity to the front edge of the base.

In yet another aspect, the hand grip member may be generally elongated and formed along a front edge of the base.

In another aspect, the at least one hand grip member may include a raised portion protruding from the base.

In another aspect, the at least one hand grip member may include at least one grip slot extending through the base.

In another aspect, the base may include a flexible or rigid material.

In yet another aspect, the base may include materials including but not limited to plastic or other synthetic material, wood, metal, fiberglass, and combinations thereof.

In another aspect, the base may be adaptable to graduated sizes to accommodate the sizes of diapers required for growing infants or handicapped or disabled persons.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention is directed toward a diaper changing device which can assist parents or other caregivers in changing diapers, such as, but not limited to, disposable or reusable diapers.

Figure 1:
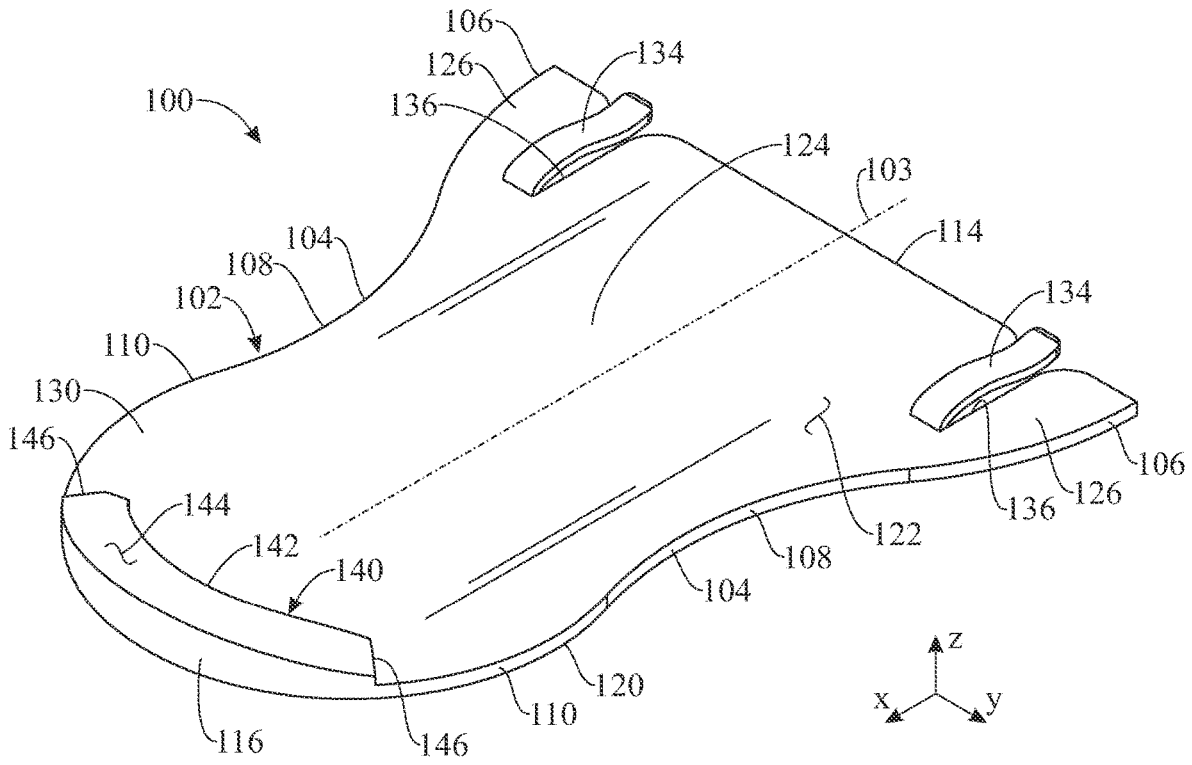
FIG. 1 presents a top, front perspective view of a diaper changing device in accordance with an illustrative embodiment of the present invention.
Figure 5:
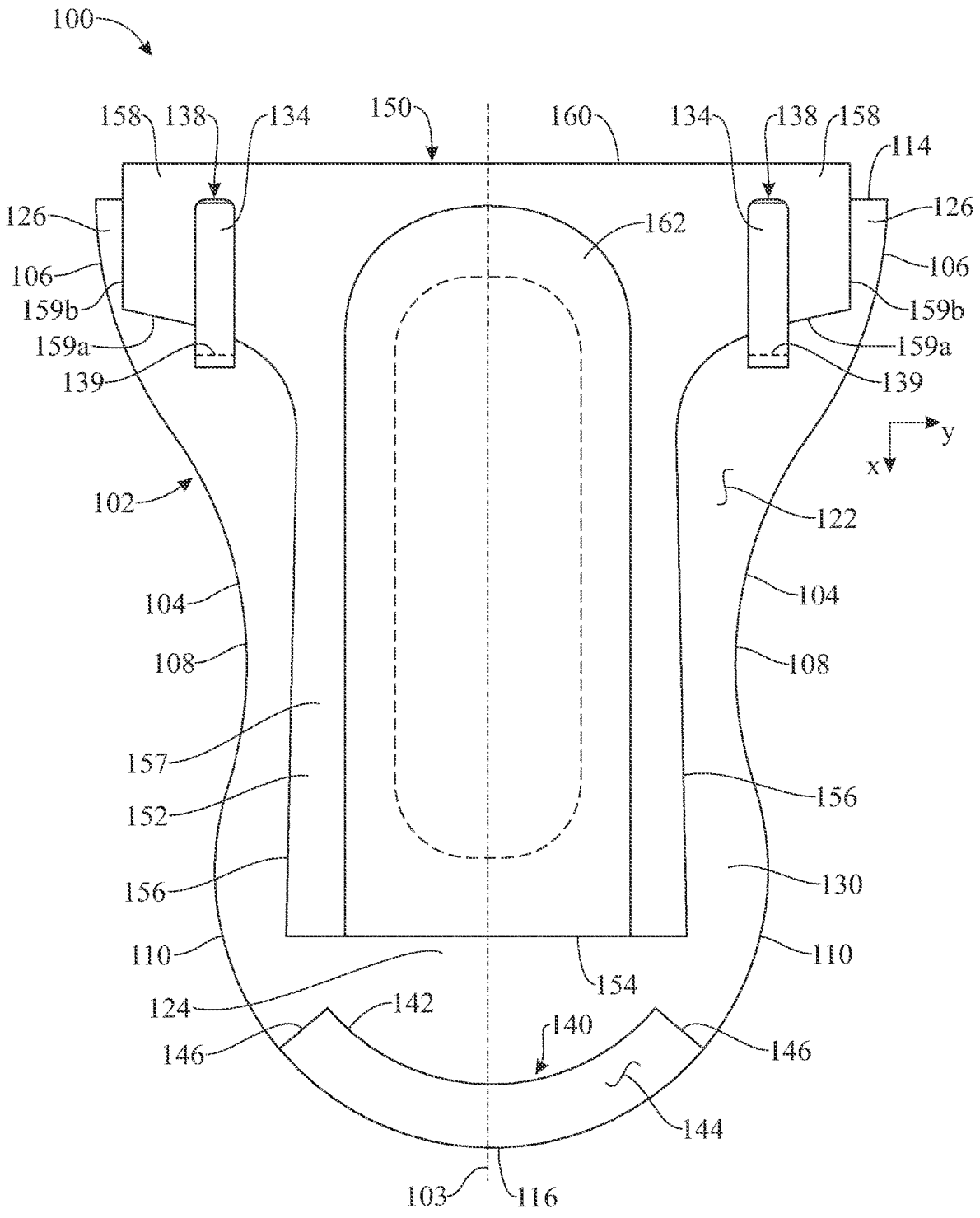
FIG. 5 presents a top plan view of the diaper changing device, with a diaper deployed and secured in place on the base and retained thereon by engagement of the diaper retainer tabs.
Figure 6:
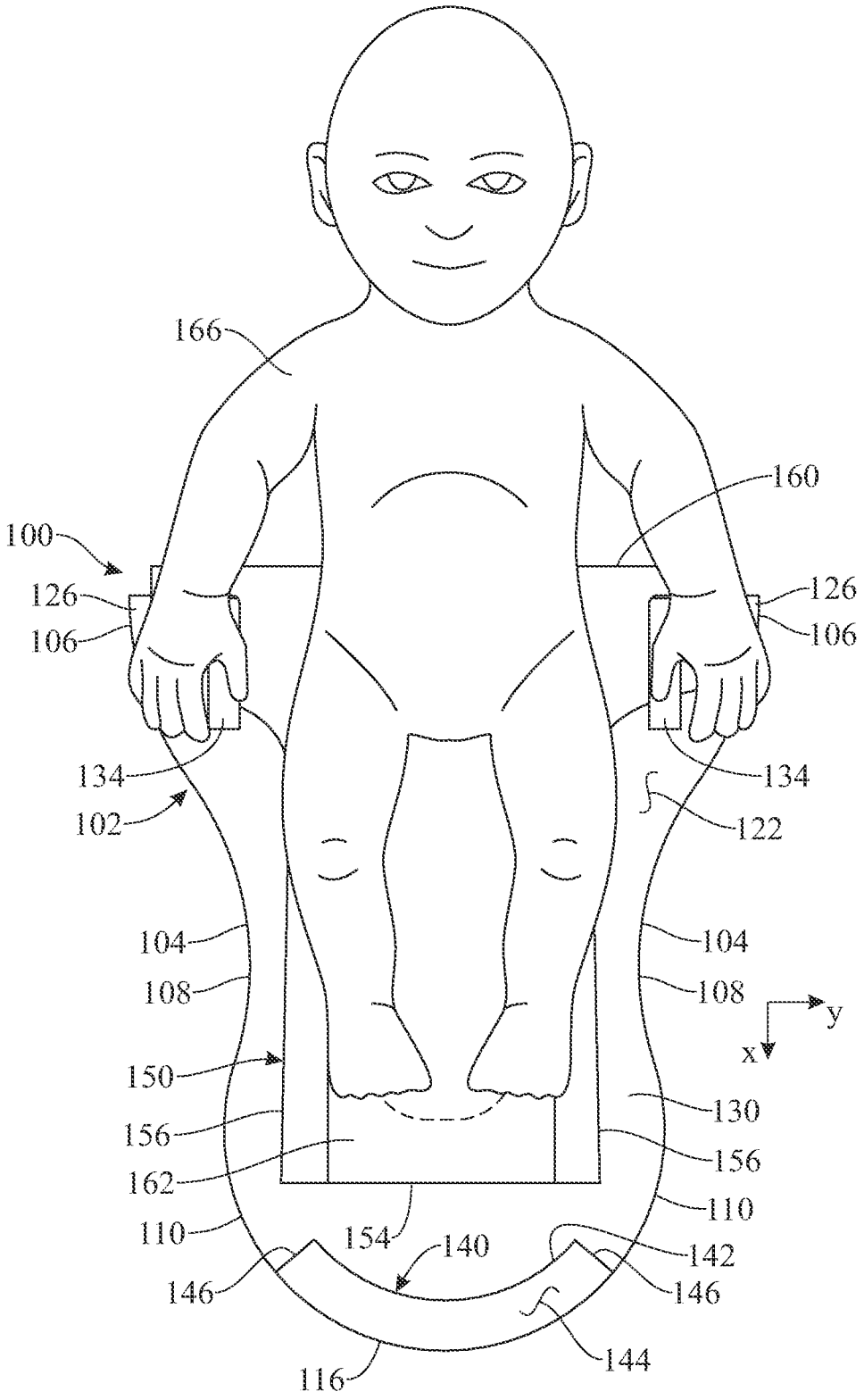
FIG. 6 presents a top plan view of the diaper changing device illustrated in FIG. 5, with an infant placed on the diaper for placement of the diaper on the infant.
Figure 7:
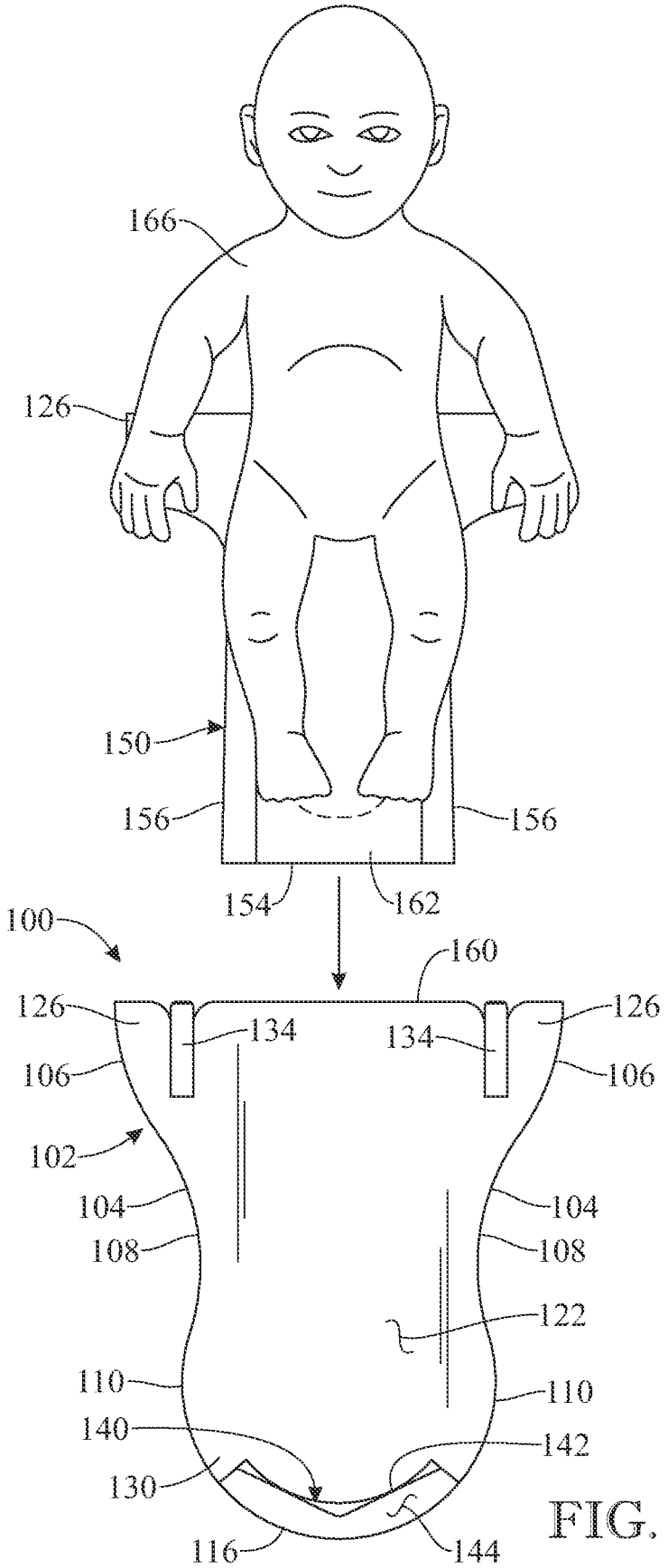
FIG. 7 presents a top plan view of the diaper changing device, more particularly illustrating pulling of the diaper changing device off of the diaper, prior to securing the diaper on the infant.

Referring initially to FIG. 1, a diaper changing device 100 is illustrated in accordance with an exemplary embodiment of the present invention. As shown in FIGS. 5-7, in typical application, which will be hereinafter described, the diaper changing device 100 may be used by a caregiver to maintain diaper fasteners or closures (not illustrated) typically at the top corners (not illustrated) on a diaper 150 in an easily reachable or accessible, strategically placed position as the diaper 150 is changed on an infant 166 or adult.

As shown for instance in FIG. 1, the diaper changing device 100 may include a device main body or base 102. At least one diaper retainer tab 134 may be provided on the base 102. In some embodiments, a pair of spaced-apart diaper retainer tabs 134 may be provided on the base 102. As illustrated in FIG. 5, the diaper retainer tabs 134 may be configured to engage and secure a diaper 150 in place on the base 102. The diaper changing device 100 may thus properly position the diaper 150 for subsequent fastening of the diaper 150 on the infant 166.

Figure 2:
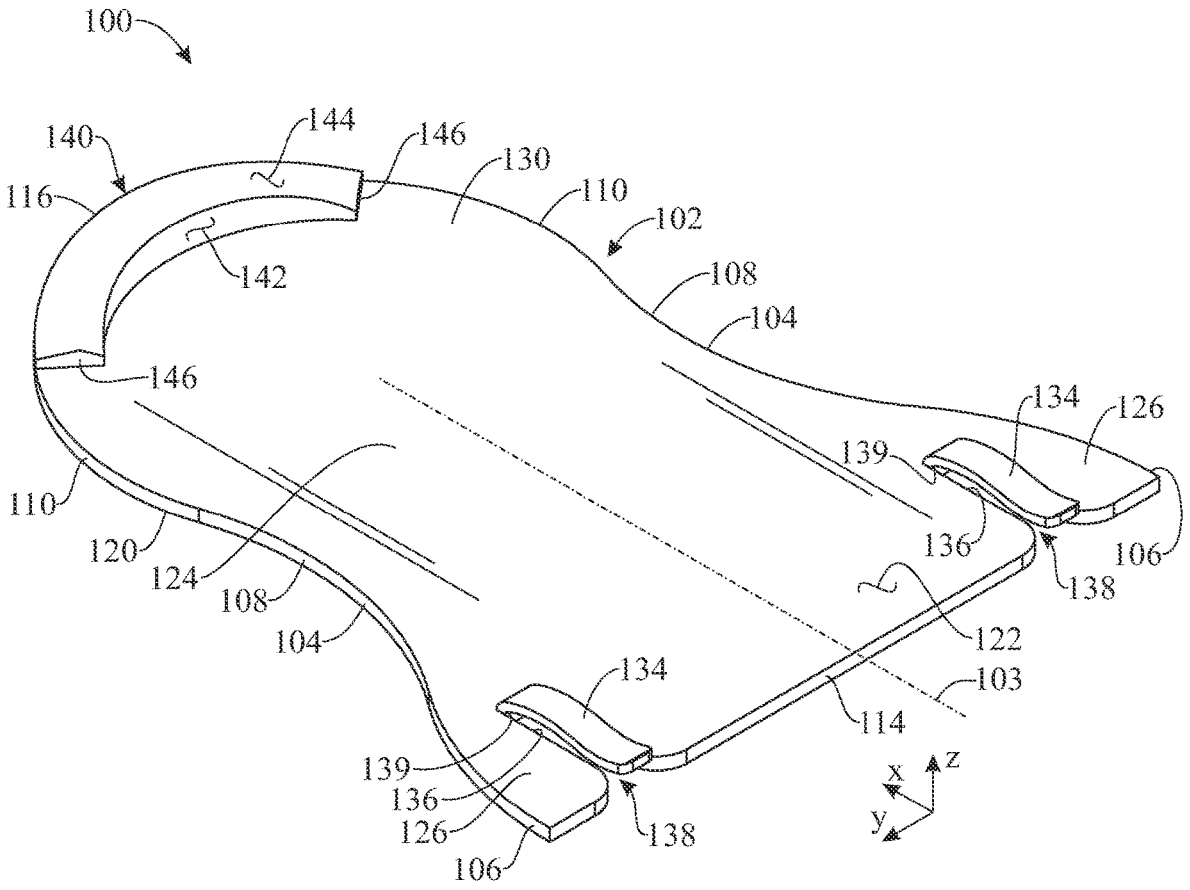
FIG. 2 presents a top, rear perspective view of the diaper changing device illustrated in FIG. 1.
Figure 3:
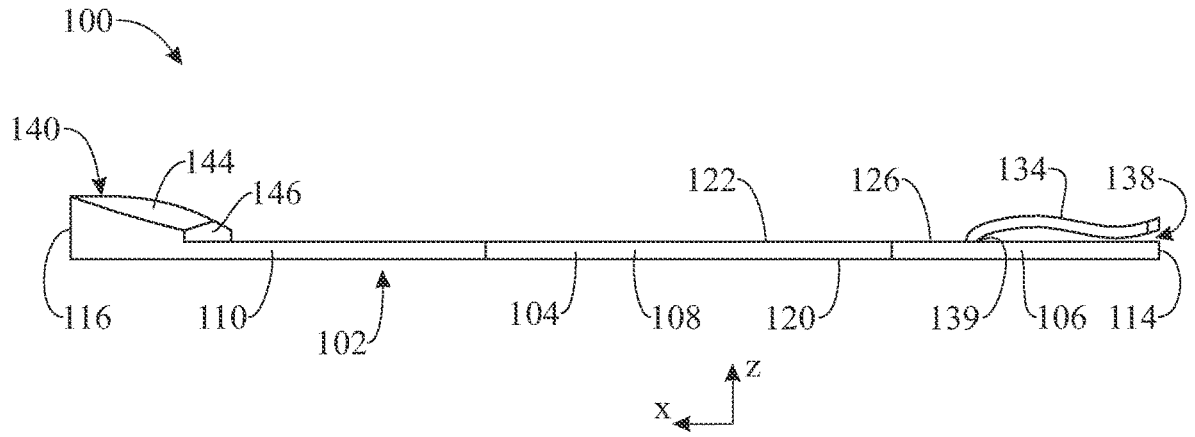
FIG. 3 presents a right side elevation view of the diaper changing device.
Figure 4:
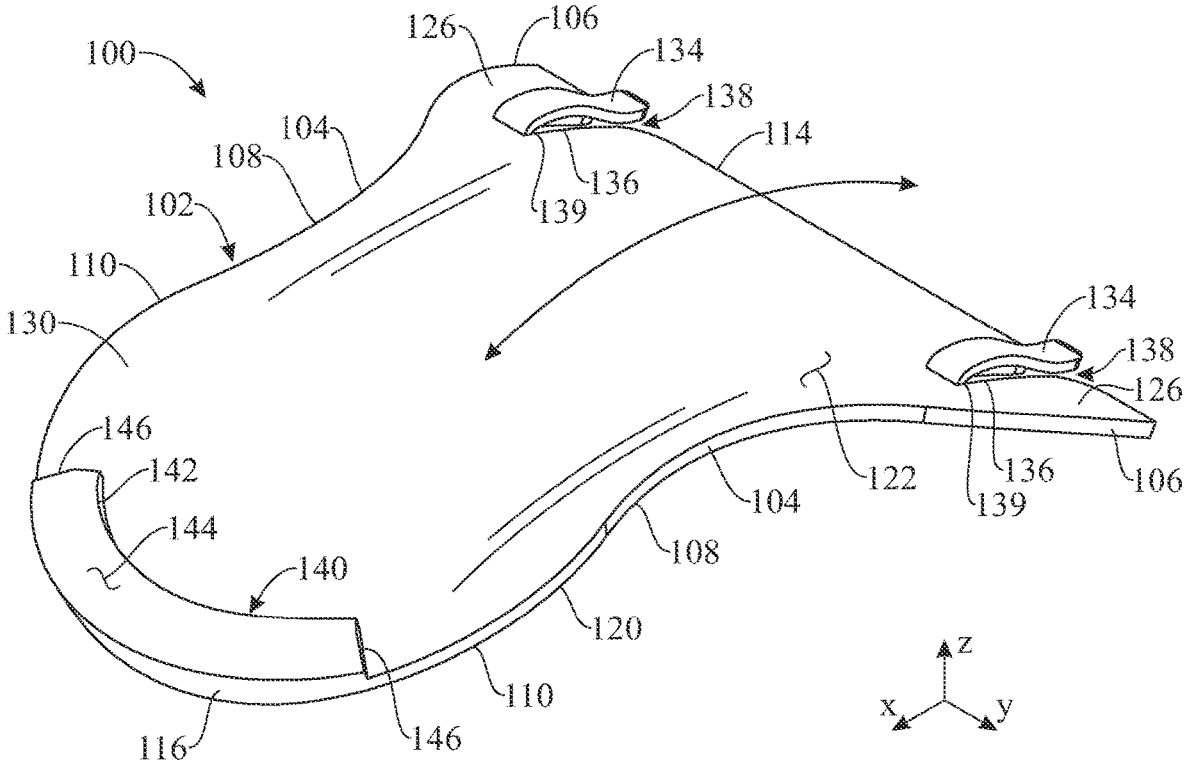
FIG. 4 presents a top, front perspective view of the diaper changing device, more particularly illustrating flexibility of the base in some embodiments of the invention.

As best shown in FIGS. 1-3, the base 102 may be formed as a generally planar piece, plate or panel. For instance, the planar base 102 may be formed along an x-y plane, i.e. a plane formed along a front-to-back or longitudinal direction x and a left-to-right or transverse direction y (perpendicular to the longitudinal direction x), as shown. The base 102 may include a flexible or rigid material. For instance, in some embodiments, the base 102 may be generally rigid, providing a relatively undeformable supporting structure or surface on which to place a diaper, as will be described hereinafter. In other embodiments, the base 102 may be flexible. For example, as illustrated in FIG. 4, in some embodiments, the base 102 may be bendable. Materials which are suitable for the base 102 may include but are not limited to plastic or other synthetic material, wood, metal, fiberglass, and combinations thereof. The base 102 is preferably non-stretchable, such that pulling on the base 102 allows a user to rapidly and easily displace the base 102, for purposes that will be described hereinafter.

As illustrated in FIGS. 1 and 2, the base 102 may have a pair of spaced-apart, left and right side edges 104. A rear edge 114 and a front edge 116 may extend between the side edges 104. The base 102 may include a flat or planar, bottom side or surface 120. The bottom surface 120 may extend from the side edges 104, the rear edge 114 and the front edge 116 of the base 102. The base 102 may further include a flat or planar, upper side or surface 122. The top surface 122 may extend from the side edges 104, the rear edge 114 and the front edge 116, opposite the bottom surface 120. In some embodiments, such as the present embodiment, the bottom and top surfaces 120 and 122 may be generally parallel to one another, as best shown in FIG. 3.

With continued reference to FIGS. 1 and 2, the diaper retainer tabs 134 may be arranged in spaced-apart relationship with one another and aligned with one another in the left-to-right or transverse direction y. As shown, the diaper retainer tabs 134 may be arranged equidistant from a central longitudinal axis 103 of the base 102, facilitating symmetrical use of the diaper retainer tabs 134, contributing to a more intuitive operation of the diaper changing device 100. In some embodiments, the diaper retainer tabs 134 may be disposed at or in proximity to the rear edge 114 of the base 102. In the present embodiment, the diaper retainer tabs 134 are provided adjacent the rear edge 114 and extend to the rear edge 114. In other embodiments, the diaper retainer tabs 134 may be provided at the rear edge 114, the front edge 116 and/or the side edges 104 of the base 102.

The diaper retainer tabs 134 may protrude beyond the top surface 122 of the base 102. The diaper retainer tabs 134 may be disposed generally parallel to one another. Alternatively or additionally, the diaper retainer tabs 134 may be similarly or identically formed relative to each other. For example, the diaper retainer tabs 134 of the present embodiment are identical, spaced apart from one another, aligned in the transverse direction y, and parallel to each other. In some embodiments, such as the present embodiment, the diaper retainer tabs 134 may be formed in, or extend along, the longitudinal direction x, and are preferably oriented rearward, as best shown in FIGS. 1 and 3. Each diaper retainer tab 134 may include a free or open end 138 and a closed end 139 arranged opposite to the open end 138, as best shown in FIG. 3. In some embodiments, the diaper retainer tab 134 may be sloped towards the top surface 122 at or near the free or open end 138, contributing to better retain the diaper 150 beneath the diaper retainer tab 134 and to optionally at least partially block transverse movement of the diaper 150 relative to the diaper retainer tab 134; for instance and without limitation, the diaper retainer tab 134 may be curved or arcuate, i.e. may extend in a curved or arcuate configuration from the closed end 139 to the free, open end 138. The curved or arcuate shape of each diaper retainer tab 134 may facilitate gripping engagement of the diaper 150 between the base 102 and the diaper retainer tab 134. In some embodiments, a tab slot 136 may underlie each diaper retainer tab 134. The tab slot 136 may be formed in the longitudinal direction x. Alternatively or additionally, the tab slot 136 may be open, i.e. may extend to an edge of the base 102, such as the rear edge 114, as shown. In some embodiments, the diaper retainer tabs 134 may be elastically deformable, and may be elastically biased downward, i.e. towards the base 102, thereby providing a clipping effect on a diaper portion inserted between the diaper retainer tabs 134 and the base 102.

In some embodiments, the diaper retainer tabs 134 may be extensions of the base 102, i.e. in material continuity and integrally formed with the base 102, with the same material and flexibility than the base 102. The diaper retainer tabs 134 may be cut from the base 102 to form the respective underlying tab slots 136, such that each diaper retainer tab 134 extends from the base 102 at the closed end 139 of the diaper retainer tab 134. The diaper retainer tabs 134 may then be heated, molded or otherwise shaped to form a curved shape which will facilitate secure or firm gripping of the diaper 150 between the base 102 and each diaper retainer tab 134. Alternative embodiments are contemplated, however, in which the base 102 and the diaper retainer tabs 134 may be fabricated separately. The diaper retainer tabs 134 may be shaped or molded and attached to the base 102 according to the knowledge of those skilled in the art.

With reference to FIGS. 1 and 5, the base 102 of the diaper changing device 100 may include an elongated central portion 124. The central portion 124 may be elongately formed along the longitudinal direction x and may extend from the front edge 116 to the rear edge 114, and further to the side edges 104. The base 102 may further include a pair of side-protruding wing portions 126 extending from the elongated, central portion 124 of the base 102. The wing portions 126 may be arranged at or near the rear edge 114. For instance, in some embodiments, such as the present embodiment, the wing portions 126 are arranged at the rear edge 114 such that a rear edge of the wing portions 126 provides a portion of the rear edge 114 of the base 102. In such embodiments, the base 102 may have a generally T-shaped configuration. In some embodiments, the T-shaped configuration may be formed entirely or partially by rounded edges; for example, in the non-limiting example shown in the drawings, as best shown in FIG. 5, the T-shaped configuration of the base 102 is mostly defined by rounded edges (front edge 116 and side edges 104), with the exception of the rear edge 114 being straight.

In some embodiments, the diaper retainer tabs 134 may protrude from the top surface 122, or otherwise be provided on the base 102, at or in proximity to the respective wing portions 126. For example, in the present embodiment, the diaper retainer tabs 134 are arranged on the wing portions 126, and are farther from the central longitudinal axis 103 of the base 102 than the left and right side edges 104 of the central portion 124 of the base 102. This increased separation between the diaper retainer tabs 134 relative to one another, compared with the width of the central portion 124 of the base 102, may enhance the ability of the diaper retainer tabs 134 to secure free or lateral portions of the diaper, as will be described hereinafter.

As shown in FIGS. 1, 2 and 5, the elongated central portion 124 of the base 102 may include an expanded or widened, front end portion 130. The front end portion 130 of the elongated central portion 124 may have a generally larger width, or dimension along the transverse direction y, than the remainder of the elongated central portion 124, and may protrude beyond opposite sides of the base 102 at the front edge 116.

In some embodiments, at least one hand grip member 140 may be provided on or in the base 102, such as on or in the elongated central portion 124 of the base 102. The at least one hand grip member 140 is configured to provide a gripping portion for a user to grip with one or both hands and facilitate pulling on the base 102 for purposes that will be described hereinafter. In some embodiments, the at least one hand grip member 140 may be arranged generally or mostly transversely, i.e. in the transverse direction y, as shown for instance in the present embodiment.

With continued reference to FIGS. 1, 2 and 5, the at least one hand grip member 140 may be provided at or near the front edge 116 of the base 102. For instance, the hand grip member 140 may be provided on the front end portion 130 of the elongated central portion 124 at or in proximity to the front edge 116 of the base 102. The hand grip member 140 may extend from the top surface 122 of the base 102, i.e. may include a raised portion protruding from the top surface 122 of the base 102. In preferred embodiments, the hand grip member 140 may extend along or adjacent to the front edge 116. For instance, in the depicted embodiment, the hand grip member 140 is arranged along the front edge 116 of the front end portion 130 of the base 102 and extends upward (in vertical direction z, which is perpendicular to the longitudinal direction x and transverse direction y) from the top surface 122 of the base 102 at the front end portion 130. The hand grip member 140 may be include an inner grip surface 142, an upper grip surface 144 and a pair of end grip surfaces 146. In some embodiments, such as the present embodiment, the hand grip member 140 may be generally elongated, such as elongately formed along the front edge 116. Alternatively or additionally, the hand grip member 140 may be curved, such as to conform to the contour or shape of the curved front edge 116.

Each side edge 104 of the base 102 may be curved, straight or angled. As illustrated in FIGS. 1 and 2, in some embodiments, the side edges 104 may each include a convex rear side edge segment 106 which extends from the rear edge 114. The rear side edge segments 106 of the respective side edges 104 may demarcate the outer boundaries of the respective wing portions 126. Each side edge 104 may further include a concave middle side edge segment 108. The concave middle side edge segment 108 may extend from the convex rear side edge segment 106. A convex front side edge segment 110 may extend from the concave middle side edge segment 108. In turn, as mentioned heretofore, the rear edge 114 of the base 102 may be straight and may extend between the rear side edge segments 106 of the side edges 104. The front edge 116 may be convex and may extend between the front side edge segments 110 of the side edges 104.

Referring next to FIGS. 5-7, in an illustrative application of the diaper changing device 100 of the present disclosure, the diaper changing device 100 may be used by a caregiver in changing a disposable or reusable diaper 150 on an infant 166 or infirm person. The diaper 150 may have a standard or conventional design with a plastic, cloth and/or fabric main diaper panel 152. The diaper panel 152 may have a front edge 154 and a pair of side edges 156 extending from the front edge 154. The front and side edges 154 and 156 of the diaper panel 152 may be straight. The diaper panel 152 may include an elongated central portion 157, which may extend from the front and side edges 156 and 156. A pair of diaper panel wings 158 may extend outwardly from elongated central portion 157 at the respective side edges 156. As best shown in FIG. 5, each diaper panel wing 158 may include a respective front edge 159*a* and a respective outer or side edge 159*b*. The main diaper panel 152 may further include a rear edge 160, which may be comprised of, or provided by, a rear edge of the diaper panel wings 158 and a rear edge of the elongated central portion 157 of the main diaper panel 152. An absorbent diaper pad 162 may be provided on the main diaper panel 152. Diaper fasteners or closures (not illustrated) may extend from the main diaper panel 152. For example and without limitation, the diaper fasteners or closures may extend from the respective diaper panel wings 158 at the respective upper or rear corners of the main diaper panel 152. The diaper fasteners or closures may facilitate deployment and fastening of the diaper 150 around the waist and legs of the infant 166. For instance, the diaper fasteners or closures may be configured to secure the diaper panel wings 158 to a front end portion of the elongated central portion 157 of the main diaper panel 152 once the diaper panel wings 158 and front end portion of the elongated central portion 157 of the main diaper panel 152 are wrapped around an infant's body and towards each other, in typical operation of the known diaper 150.

As shown in FIG. 5, a caregiver (not illustrated) may initially place the diaper 150 on the top surface 122 of the base 102. The diaper panel wings 158 at the rear corners of the diaper 150 may be inserted through the open ends 138 of the diaper retainer tabs 134, between the diaper retainer tabs 134 and the base 102, to position the front edges 159*a* of the diaper panel wings 158 relatively close or adjacent to the closed ends 139 of the diaper retainer tabs 134. Subsequently, the diaper 150 may be manually flattened over the base 102. The top surface 122 of the base 102 being flat may facilitate flattening the diaper 150 thereon. When flattening the diaper 150, the caregiver may also pull on the front end or front edge 154 of the diaper 150 frontward, to further flatten and prepare the diaper 150 for use; when pulling the diaper front end forward, the rear end of the diaper 150 may be retained in place by the front edges 159*a* of the diaper panel wings 158 abutting against the closed end 139 of the diaper retainer tabs 134, facilitating the flattening action while allowing to maintain the diaper 150 in place. As further shown in the figure, the base 102 of the diaper changing device 100 may be generally larger than the diaper 150 and shaped and sized to extend frontward, leftward and rightward of the diaper 150 when the diaper 150 is retained in place by the diaper retainer tabs 134. Having the base 102 extend beyond the diaper 150 facilitates flattening of the diaper 150 and preventing contamination of the diaper 150 by surfaces or agents external to the diaper changing device 100.

With the diaper 150 positioned in place and flattened against the base 102, as shown in FIG. 6, the infant 166 may then be positioned on the diaper changing device 100 and diaper 150, such as with the rear edge 160 of the diaper 150 and the rear edge 114 of the base 102 of the diaper changing device 100 aligned or even with the waistline of the infant 166. With the infant resting on the diaper 150 and diaper changing device 100, the caregiver may once more pull the front end of the diaper 150 forward to flatten and stretch out the diaper 150 along the infant in a front-to-back direction, to prepare better align the front end of the diaper 150 with the diaper panel wings 158 when the diaper 150 is later wrapped over the infant. When stretching and flattening the diaper 150 frontward, the diaper retaining tabs 134 retain the rear end (rear edge 160) of the diaper 150 in place relative to the infant's waistline, as was described heretofore.

Once the diaper 150 has been properly flattened, and as shown in FIG. 7, the caregiver may then grip and pull the hand grip member 140 frontward to slip the diaper retaining tabs 134 off of the diaper panel wings 158 and to remove the diaper changing device 100 from under the infant 166, freeing the diaper panel wings 158, and leaving the diaper 150 in place under the infant 166 and the diaper fasteners or closures in place to complete the diapering process. The caregiver may then wrap the front end and the diaper panel wings 158 of the diaper 150 over the infant, as is typically carried out when conventionally placing a diaper. The diaper fasteners or closures on the diaper 150 may then be easily accessed and deployed as the diaper 150 is typically secured around the waist and legs of the infant 166. Alternatively, the caregiver may choose not to pull out the diaper changing device 100 prior to wrapping the diaper 150 over the infant, and may instead first wrap the front end of the diaper 150 over the infant while the diaper retaining tabs 134 maintain the rear end of the diaper 150 in place, and then proceed to remove the diaper changing device 100 to free the diaper panel wings 158 and allow the caregiver to secure the diaper panel wings 158 to the front end of the diaper 150. In both alternative usage sequences, the diaper changing device 100 assists the caregiver in maintaining the diaper 150 correctly flattened and positioned during the diapering sequence.

Figure 8:
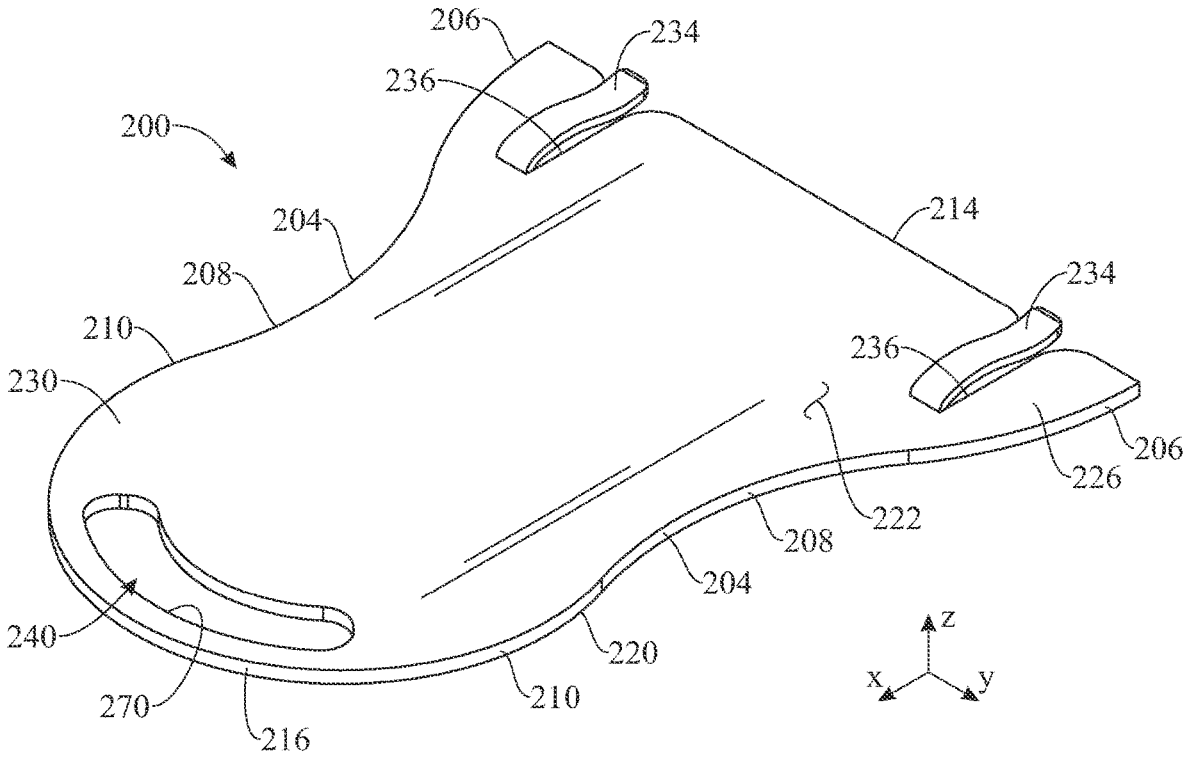
FIG. 8 presents a front perspective view of an alternative illustrative embodiment of the diaper changing device.

Referring next to FIG. 8, an alternative illustrative embodiment of the diaper changing device is generally indicated by reference numeral 200. In the diaper changing device 200, elements which are analogous to the respective elements of the diaper changing device 100 that was heretofore described with respect to FIGS. 1-7 are designated by the same respective numerals in the 200-299 series in FIG. 8. For example, the hand grip member, referred to in the previous embodiment with reference numeral 140, is indicated in FIG. 8 with reference numeral 240. As can be seen, the construction of the diaper changing device 200 is generally the same as that of the diaper changing device 100 of the previous embodiment. However, in the diaper changing device 200 of the present embodiment, the hand grip member 240 includes at least one grip slot 270 which extends through the base 202. The grip slot 270 may be elongated and curved and may be disposed at or proximate and typically parallel to the front edge 216 of the base 202, similarly to the protruding hand grip member 140 of the previous embodiment. Application of the diaper changing device 200 may be as was heretofore described with respect to the diaper changing device 100.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A diaper changing device suitable for assisting a caregiver in changing a diaper on a subject, the diaper changing device comprising:

a base, configured to support a diaper in an extended and flattened position; and at least one diaper retainer tab carried by the base, the at least one diaper retainer tab configured to disconnectably engage the diaper; wherein the diaper changing device is configured to adopt a usage configuration in which a diaper is extended and flattened on the base, and further in which the at least one diaper retainer tab engages the diaper and prevents a relative movement between the diaper and the base while maintaining a front end portion of the diaper free to be separated from the base and wrapped over a subject resting on the diaper, and further in which the base is disconnectable from the diaper by pulling the base frontward relative to the diaper to disengage the diaper from the at least one diaper retainer tab.

2. The diaper changing device of claim 1, wherein the base is generally flat.

3. The diaper changing device of claim 1, wherein the base is elongated along a front-to-back, longitudinal direction, and further in which, in the usage configuration, the base extends frontward of the diaper.

4. The diaper changing device of claim 3, wherein, in the usage configuration, the base extends transversely beyond a left side and a right side of the diaper.

5. The diaper changing device of claim 1, wherein, in the usage configuration, the at least one diaper retainer tab prevents a frontward movement of the diaper relative to the base when the front end of the diaper is pulled frontward relative to the base in the usage configuration.

6. The diaper changing device of claim 1, wherein the at least one diaper retainer tab comprises a pair of diaper retainer tabs arranged on a left side and a right side of the base in spaced-apart relationship with one another and configured to engage a left side and a right side of the diaper.

7. The diaper changing device of claim 6, wherein the base comprises a central portion and a pair of wing portions, wherein the central portion is elongately formed along a front-to-back, longitudinal direction, and each wing portion of the pair of wing portions extends transversely outward from a respective left and right side of the central portion, and further wherein each diaper retainer tab of the pair of diaper retainer tabs is arranged on a respective wing portion of the pair of wing portions.

8. The diaper changing device of claim 1, wherein the at least one diaper retainer tab protrudes from a top surface of the base.

9. The diaper changing device of claim 8, wherein a free end of the at least one diaper retainer tab is sloped towards the top surface of the base.

10. The diaper changing device of claim 1, wherein each diaper retainer tab of the at least one diaper retainer tab is arranged adjacent to a rear end of the base.

11. The diaper changing device of claim 1, wherein each diaper retainer tab of the at least one diaper retainer tab is oriented rearward.

12. The diaper changing device of claim 1, wherein the base further comprises at least one hand grip member configured to facilitate a frontward pulling of the base relative to the diaper in the usage configuration.

13. The diaper changing device of claim 12, wherein the at least one hand grip member is arranged frontward of the diaper in the usage configuration.

14. The diaper changing device of claim 12, wherein the at least one hand grip member is provided at or in proximity to the front edge of the base.

15. The diaper changing device of claim 12, wherein the at least one hand grip member is generally elongated and formed along a front edge of the base.

16. A diaper changing device suitable for assisting a caregiver in changing a diaper on a subject, the diaper changing device comprising:

a base, elongately formed along a front-to-back longitudinal direction and configured to support a diaper in an extended and flattened position; and at least one diaper retainer tab carried by the base, the at least one diaper retainer tab configured to disconnectably engage the diaper; wherein the diaper changing device is configured to adopt a usage configuration in which a diaper is extended and flattened on the base, and further in which the at least one diaper retainer tab engages the diaper and prevents a frontward movement of the diaper relative to the base when a front end of the diaper is pulled frontward relative to the base, while maintaining the front end portion of the diaper free to be separated from the base and wrapped over a subject resting on the diaper, and further in which the base is disconnectable from the diaper by pulling the base frontward relative to the diaper to disengage the diaper from the at least one diaper retainer tab.

17. A diaper changing device suitable for assisting a caregiver in changing a diaper on a subject, the diaper changing device comprising:

a base, elongately formed along a front-to-back longitudinal direction and configured to support a diaper in an extended and flattened position;

at least one diaper retainer tab carried by the base, the at least one diaper retainer tab configured to disconnectably engage the diaper; and at least one hand grip member provided on the base; wherein the diaper changing device is configured to adopt a usage configuration in which a diaper is extended and flattened on the base, and further in which the at least one diaper retainer tab engages the diaper and prevents a frontward movement of the diaper relative to the base when a front end of the diaper is pulled frontward relative to the base, while maintaining the front end portion of the diaper free to be separated from the base and wrapped over a subject resting on the diaper, and further in which the at least one hand grip member is arranged frontward of the diaper, and the base is disconnectable from the diaper by pulling the at least one hand grip member frontward relative to the diaper to disengage the diaper from the at least one diaper retainer tab.

* * * * *